US007967733B2

(12) United States Patent
Abelbeck

(10) Patent No.: US 7,967,733 B2
(45) Date of Patent: Jun. 28, 2011

(54) EXERCISE DEVICE

(75) Inventor: Kevin G. Abelbeck, Fort Collins, CO (US)

(73) Assignee: Don Walker, Bullhead City, AZ (US)

( * ) Notice: Subject to any disclaimer, the term of this patent is extended or adjusted under 35 U.S.C. 154(b) by 300 days.

(21) Appl. No.: 12/231,932

(22) Filed: Sep. 8, 2008

(65) Prior Publication Data

US 2010/0062906 A1 Mar. 11, 2010

(51) Int. Cl.
*A63B 69/06* (2006.01)
*A63B 22/00* (2006.01)
*A62B 26/00* (2006.01)

(52) U.S. Cl. ..... 482/51; 482/72; 482/62; 482/140

(58) Field of Classification Search ..... 482/51–52, 482/72, 130, 140, 142, 71, 57, 95–96
See application file for complete search history.

(56) References Cited

U.S. PATENT DOCUMENTS 3,186,757 A * 6/1965 Hopkins ..... 297/28
4,690,398 A * 9/1987 Smith ..... 482/73
4,722,525 A 2/1988 Brentham
4,986,261 A 1/1991 Iams et al.
5,273,508 A 12/1993 Jones
5,356,356 A 10/1994 Hildebrandt et al.
5,417,630 A * 5/1995 Schultz ..... 482/70
5,419,747 A 5/1995 Piaget et al.
5,445,583 A 8/1995 Habing
5,486,150 A 1/1996 Randolph
5,681,250 A 10/1997 Hoover et al.
5,743,832 A 4/1998 Sands et al.
6,120,416 A * 9/2000 Walker ..... 482/57
6,135,930 A * 10/2000 Kuo ..... 482/72
6,902,231 B1 * 6/2005 Tseng ..... 297/27
D520,084 S 5/2006 McVay et al.
7,070,545 B2 7/2006 Lull et al.
D528,174 S 9/2006 McVay et al.
D528,614 S 9/2006 McVay et al.
7,108,644 B2 9/2006 Clark, III

* cited by examiner

*Primary Examiner* — Steve R Crow

(57) ABSTRACT

An exercise device is provided, having a frame, an arm link pivotally coupled to the frame, a leg link pivotally coupled to the frame and a countermovement mechanism coupling the arm link and the leg link to enable substantially opposite direction of movement of the arm link relative to the leg link. A first and second set of the arm and leg links may be provided and positioned each adjacent a seat adapted to support a user. The range of motion of the arm links and therefore the leg links are controlled by the user as well as the direction of movement of the first set relative to the second set. This enables the user to perform a simulated walking gait exercise by moving the first and second arm links in generally opposing directions or an abdominal exercise by moving the first and second arms links in substantially the same direction.

26 Claims, 6 Drawing Sheets

EXERCISE DEVICE

FIELD OF THE INVENTION

The present invention generally relates to exercise equipment and more specifically to exercise equipment that supports the user and enables simultaneous upper and lower body exercise and may further include an abdominal exercise.

BACKGROUND OF THE INVENTION

Exercise has become an important part of our modern society. The need to exercise is an inherent compliment to our high tech and likely sedentary lifestyle. To fill that need, fitness equipment is desired to be both functional and versatile. A piece of equipment that can perform more than one function has advantages in both space savings as well as lower cost of ownership relative to two individual single function machines.

For many individuals walking may be one of the most beneficial basic activities. There are limitations though for some people. The impact of joint loading may be extreme for some, especially those recovering from an injury or those in a very de-conditioned state. Space to walk may be a consideration for walking inside whereas weather conditions and personal safety may be considerations for walking outdoors. Strengthening the abdominal muscles is desirable in terms of posture, lower back health and general appearance. Cardiovascular exercise, such as walking, may be desirable to do in combination with abdominal exercises to reduce body fat, increase strength and overall fitness.

It should, therefore, be appreciated that there is a need for a physical training device that enables a simulated walking gait while the user is supported and therefore the joints are unloaded. The device may include the ability for the range of motion to be user defined so as to automatically adjust to different body sizes and joint flexibility ranges. In addition, the device may include the ability to perform a trunk flexion exercise. The present invention fulfills this need and others.

SUMMARY OF THE INVENTION

The present invention provides a frame with a pair of arm links pivotally coupled to the frame about a first axis. A pair of legs is pivotally coupled to the frame about a second axis, the first axis non-collinear with the second axis. A first countermovement mechanism is pivotally coupled to the frame about a third axis and adapted to provide a user defined range of motion of a first arm link of the pair of arm links that is substantially opposite in direction to a first leg link of the pair of leg links. Also included may be an independent second countermovement mechanism which may be pivotally coupled to the frame about the third axis and adapted to provide a user defined range of motion of a second arm link of the pair of arm links that is substantially opposite in direction to a second leg link of the pair of leg links. The pair of arms may move in the same direction to perform an abdominal exercise or in opposing directions to perform a simulated walking gait exercise.

In a presently preferred embodiment of the invention, there may be included a bias member, such as a spring, elastic cord or pneumatic cylinder or spring, with a first end coupled to the frame and a second end coupled to the an arm link. The bias member may be movable relative to the arm link by providing a slide block that is movably mounted to the arm link. The slide block may also include an indexing pin adapted to secure the slide block in a determined position on the arm link.

A seat may also be included that is supported by the frame and includes a substantially flat back portion contiguous to a substantially flat lower portion. The orientation of the back portion to the lower portion may be approximately 111 degrees. The seat may be comprised of a seat frame including a base section and a removable section that is releasably secured to the base section adjacent to a seat cross brace. As was further determined by the applicant, a ratio of approximately 4/3 may be used as the ratio of movement of the leg link relative to the arm link.

An exemplary method for exercise is also disclosed including providing the elements of the device as previously noted. The method of exercise may include the steps of positioning a user on the seat, moving the arms and legs of the user in an opposing manner so as to simulate a walking gate and moving the arms of the user in the same direction and the legs of the user in the same direction so as to perform an abdominal exercise. The method may also include the steps of providing a bias member coupled to the frame and a slide block received by the arm link, positioning the slide block on the arm link relative to the first axis and securing the slide block to the arm link.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment (s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
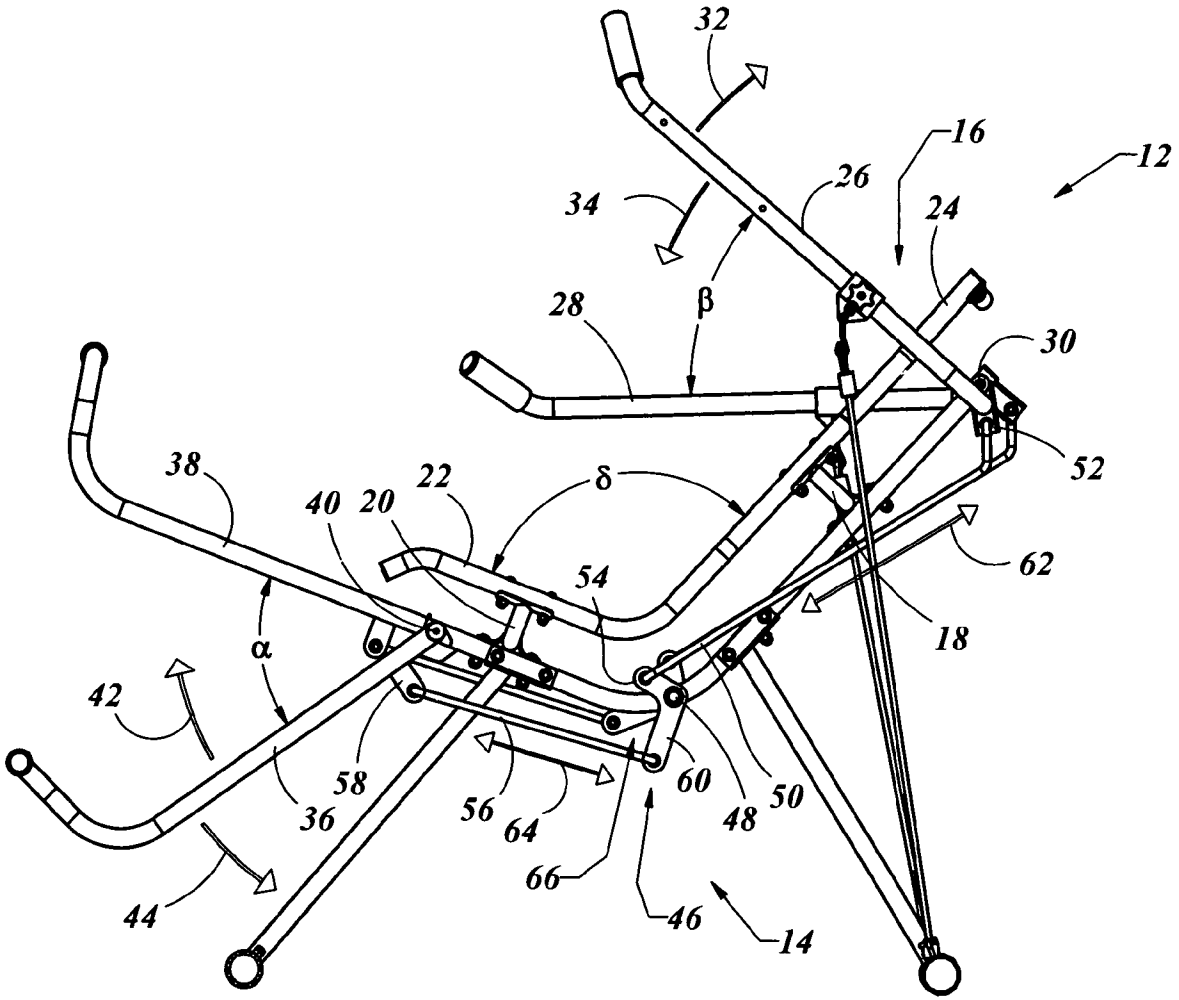
FIG. 1 is a side view of an exercise device produced in accordance with the present invention.

With reference to the illustrative drawings, and particularly to FIG. 1, there is shown a side view of an exercise device in the form of a multi-functional apparatus 12. A frame 14 supports a seat frame 16 by a first seat cross brace 18 and a second seat cross brace 20. The seat frame 16 may include a bottom portion 22 which may be contiguous with a back portion 24, the combination adapted to support a user. The angle between the bottom portion 22 and the back portion 24 is designated by small delta (δ) and has been suggested by experimentation to be approximately 111°. It is understood that this angle may vary according to individual feel and physical variability between body segment lengths and joint flexibility. For the general population it has been determined that near this angle the user feels securely supported and yet allows for a range of motion that is desirable regarding the movements performed on the apparatus 12.

A first arm link 26 is shown in an elevated position and a second arm link 28 is in a lowered position. The arm links 26 and 28 are pivotally coupled to the frame 14 at the arm axis 30 providing an angular displacement between the first arm link 26 and second arm link 28 as designated by the arm angle beta (β). The first arm link 26 and the second arm link 28 may share the same arm axis 30, but in this embodiment they are able to move independently from one another. As such, the arm angle β is user defined and maybe changed continuously. The upper arm arrow 32 and lower arm arrow 34 illustrate a movement of the first arm link 26. The second arm link 28 may follow this same displacement capacity, though independent from the first arm link 26.

Similar to the first arm link 26, there is shown a first leg link 36 and a second leg link 38, which may be pivotally coupled to the frame 14 at the leg pivot 40. The angular displacement between the legs inks 36 and 38 is designated by the leg angle alpha (α). As with the arm links 26 and 28, the positions leg links 36 and 38 are user defined and the first leg link 36 may be independent from the second leg link 38. As such, the leg angle α may vary. The upper leg arrow 42 and the lower leg arrow 44 illustrate a movement pattern capability of the first leg link 36. A similar movement may be available for the second leg link 38 though not designated by arrows.

The first arm link 26 and the first leg link 36 may be coupled by a first countermovement mechanism 46. The first countermovement mechanism 46 is coupled to the frame at the countermovement axis 48. The mechanical connection to the first arm link 26 may be by an upper push bar 50. This may be pivotally connected on both ends of the upper push bar 50 to an arm ear 52 on the first arm link 26 and an upper ear 54 on the first countermovement mechanism 46. In a similar manner, the first leg link 36 may be connected to the first countermovement mechanism 46 by a lower push bar 56 with one end coupled to a leg ear 58 that may be mounted to the first leg link 36. A second end of the lower push bar 56 may be coupled to a lower ear 60 of the first countermovement mechanism 46. In this manner generally downward movement of the first arm link 26 provides a generally upward movement of the first leg link 38, thus linking the first arm link 26 to the first leg link 36 to provide substantially opposing motion.

This movement is further illustrated by the upper arrow 62 to show the general displacement of the upper push bar 50 as it would cycle back and forth with the general movement up and down of the first arm link 26. In this embodiment the first arm link 26 and the first countermovement mechanism 46 are pivotally mounted to the frame 14. As such, the cyclic movement of the upper push bar 50 may oscillate in a curvilinear path, and not truly linear as the upper arrow 62 suggests. This is though the general path of the upper push bar 50 and any variations from a linear displacement is understood to be a function of the geometry. A lower arrow 64 also illustrates a general movement of the lower push bar 56 as the combination of the first arm link 26 and first leg link 36 are moved in the aforementioned manner.

The second arm link 28 may be coupled to the second leg link 38 by way of a second countermovement mechanism 66. The set of the first arm link 26 and the first leg link 36 may move independently from the set of the second arm link 28 and the second leg link 38. Therefore if a user actuated the first arm link 26 and first leg link 36 with their left arm and leg respectively and their right arm and leg actuated the second arm link 28 and second leg link 38 respectively, the user could move both arms down toward the lower body at the same time as both legs then moved up toward the upper body of the user. This would simulate an abdominal crunch exercise as the upper body and lower body moved together in a trunk flexion movement. Also the user may move one arm up as the other arm moves down. The countermovement mechanism 46 and 66 may cause the leg links 36 and 38 and therefore the right and left legs of the user to follow in a movement that is substantially opposite to their respective arm motion thus simulating a walking gait movement.

The relationship of the displacement of the arm links 26 and 28 relative to the leg links 36 and 38 may be varied by the length and positions of the upper ear 48 and lower ear 60 of the countermovement mechanisms 46 and 66 as well as the arm ear 52 and the leg ear 58. The ratio of displacement of the leg links 36 and 38 as designated in this embodiment by the angle α versus the arm links 26 and 28 as designated by the angle β may be expressed as the ratio of α/β. This ratio may vary but in one embodiment that ratio may be approximately 4/3.

Figure 2:
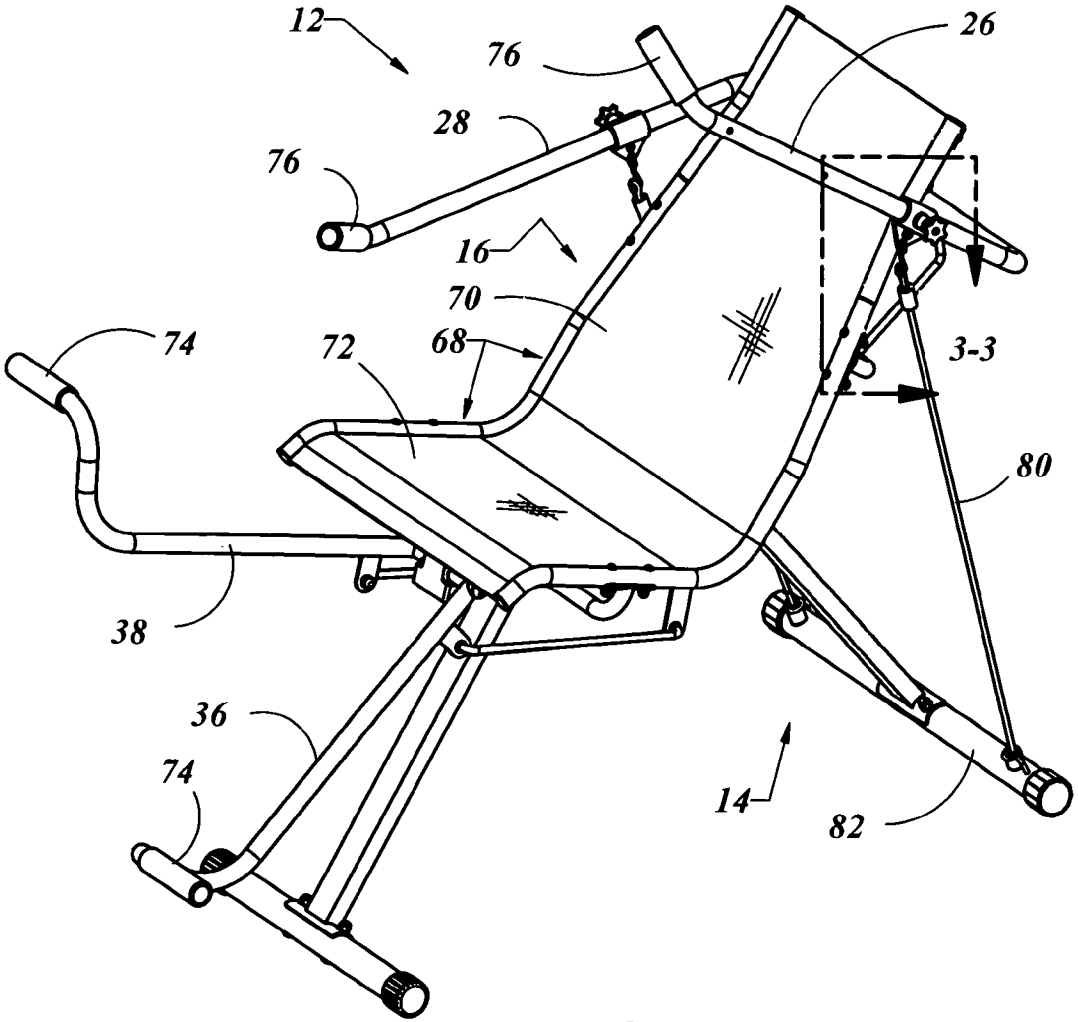
FIG. 2 is a left, front isometric view of the exercise device of FIG. 1.

With reference to FIG. 2, and front, left isometric view of the apparatus 12 is shown. The seat frame 16 supports a cover 68 thereby providing a substantially flat surface with the seat frame 16. This combination may provide a substantially flat back portion 70 adapted to support the back of a user. The back portion 70 may be contiguous with a substantially flat lower portion 72 adapted to support the lower trunk and hips of a user. The cover 68 may be a mesh material, a solid structure including a covered foam pad or any other supporting material known in the art. A foot bar 74 may be provided on the first leg link 36 and the second leg link 38 to aid in the support of a user's foot or any other portion of the user's lower extremities. A hand grip 76 may also be placed on the first arm link 26 and the second arm link 28 to aid in the grip of the user when actuating the arm links 26 and 28 during use.

Figure 3:
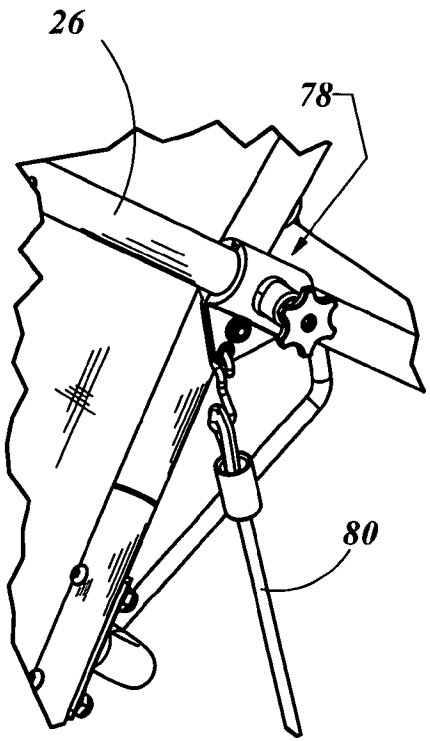
FIG. 3 is an isometric detailed view of the slide block cut along line 3-3 of FIG. 3 of the exercise device of FIG. 1.

With reference to FIGS. 2 and 3, a detail view a portion of the first arm link 26 is shown with a slide block 78 being received by the first arm link 26 and supporting a bias member 80 in FIG. 3. In FIG. 2 the bias member 80 is shown to have one end coupled to a bottom tube 82 that may be part of the frame 14. The bias member 80 may be a spring, elastic cord, pneumatic cylinder or spring or any other spring structures known in the art. The purpose of the bias member 80 is to bias the arm links 26 and 28 to a lowered position. This in turn biases the associated leg link 36 and 38 in an up or elevated position.

The advantage to the bias system is a user's legs are a substantial portion of a user's total body weight. Pushing the arm links 26 and 28 down drives the respective leg links 36 and 38 up, pulling the center of gravity of the mass of the legs up, thereby doing work. The muscular effort to accomplish this includes actuation of the hip flexor muscles to directly lift the legs or the arm, shoulder and back muscles to push the arm links 26 and 28 down or some combination of both actions. For a de-conditioned population the fatigue of these muscle groups may become apparent early in an exercise session. It has been recommended that a cardio vascular benefit from training may be achieved with periodic exercise bouts of at least twenty minutes in duration. If the user's muscles fatigue early in the exercise session, they may not make it to the twenty minute interval. The bias member 80 acts as an energy storage to reduce muscle fatigue for an un-trained population. This is accomplished when an arm link 26 or 28 is elevated, the respective leg link 36 or 38 falls, taking the weight of the user's leg with it. This process stretches the bias member, storing elastic energy in it, to be released when the respective arm link 26 or 28 is moved back down, thereby pulling the respective leg link 36 or 38 back up. By adjusting the distance of the bias member 80 away from the arm axis 30 (FIG. 1) the moment on the bias member relative to the arm links 26 and 28 changes. The closer the bias member 80 is to the hand grip 76 the greater the moment the bias member 80 has on the arm link 26 or 28 and the greater the amount of energy that is stored for a given displacement of an arm link 26 or 28. The slide block 78 may be used to facilitate that adjustment process.

Figure 5:
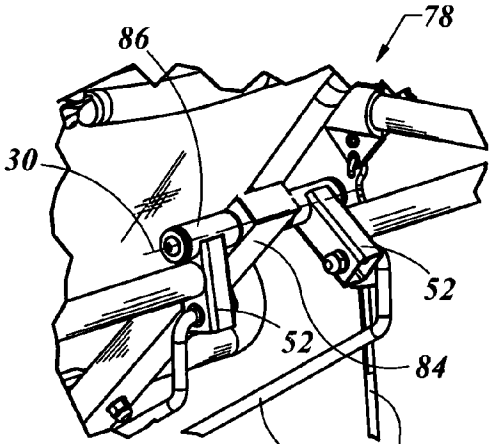
FIG. 5 is an isometric detailed view of the arm pivot cut along line 5-5 of FIG. 4 of the exercise device of FIG. 4.
Figure 6:
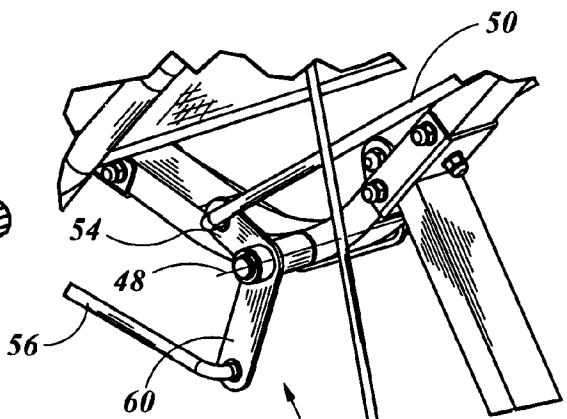
FIG. 6 is an isometric detailed view of the countermovement mechanism cut along line 6-6 of FIG. 4 of the exercise device of FIG. 4.
Figure 4:
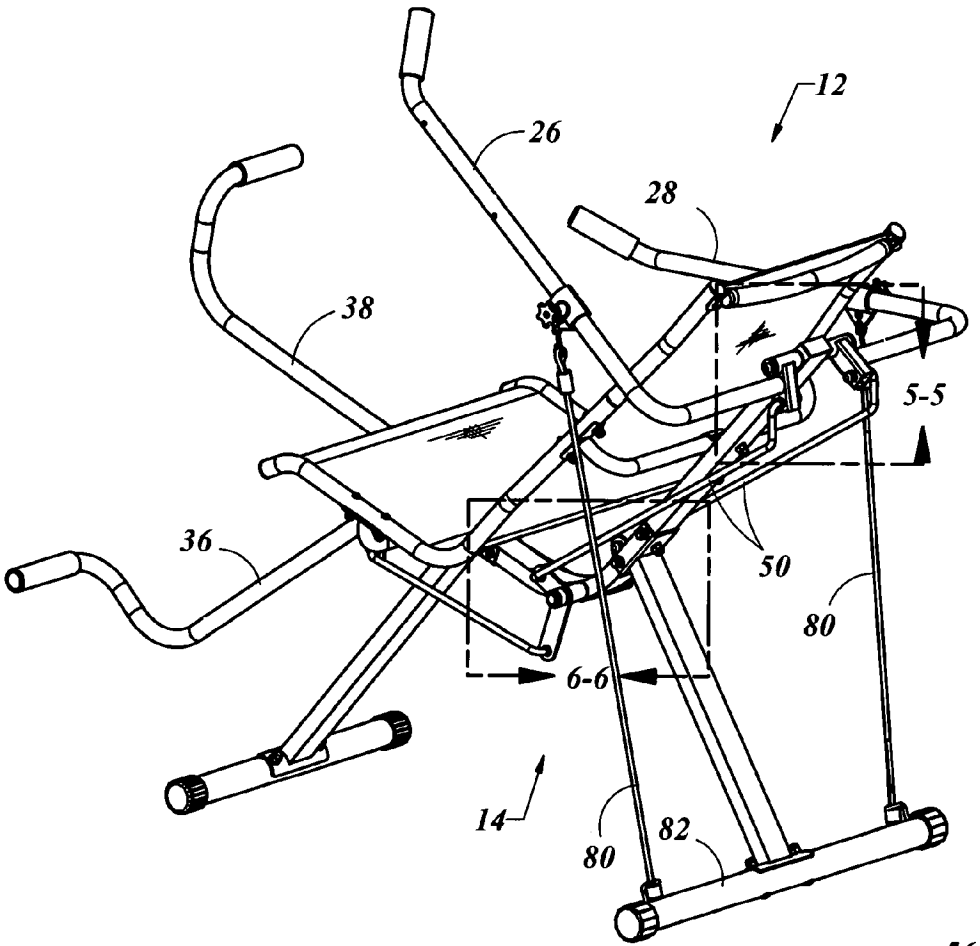
FIG. 4 is a left rear isometric view of the exercise device of FIG. 1.

With reference to FIGS. 4-6, a rear isometric view of the apparatus 12 is shown in FIG. 4 with details of the arm axis 30 and the first countermovement mechanism 46 of one embodiment shown in greater detail in FIGS. 5 and 6 respectively. The arm axis 30 which may include a shaft (not shown) secured to an upright post 84 which may be part of the frame 14. The first and second arm links 26 and 28 may each include a bearing tube **8*b*6 which rotates about the shaft (not shown) along the arm axis 30. The arm ear 52 moves with each arm link 26 and 28 to move the upper push bar 50 as each arm link 26 and 28 is moved. A lower end of the upper push bar 50 articulates the countermovement mechanism 46 in that it is coupled to the upper ear 54. The upper ear 54 may be continuous with the lower ear 60, thereby movement of one results in movement of the other. As a result the upper push bar 50 moves with the lower push bar 56. In this embodiment, the upper ear 54 is on an opposing side of the lower ear 60 relative to the countermovement axis 48, thus the general direction of movement of one push bar 50 and 56** may cause the other to move in a different and substantially opposing direction.

Figure 7:
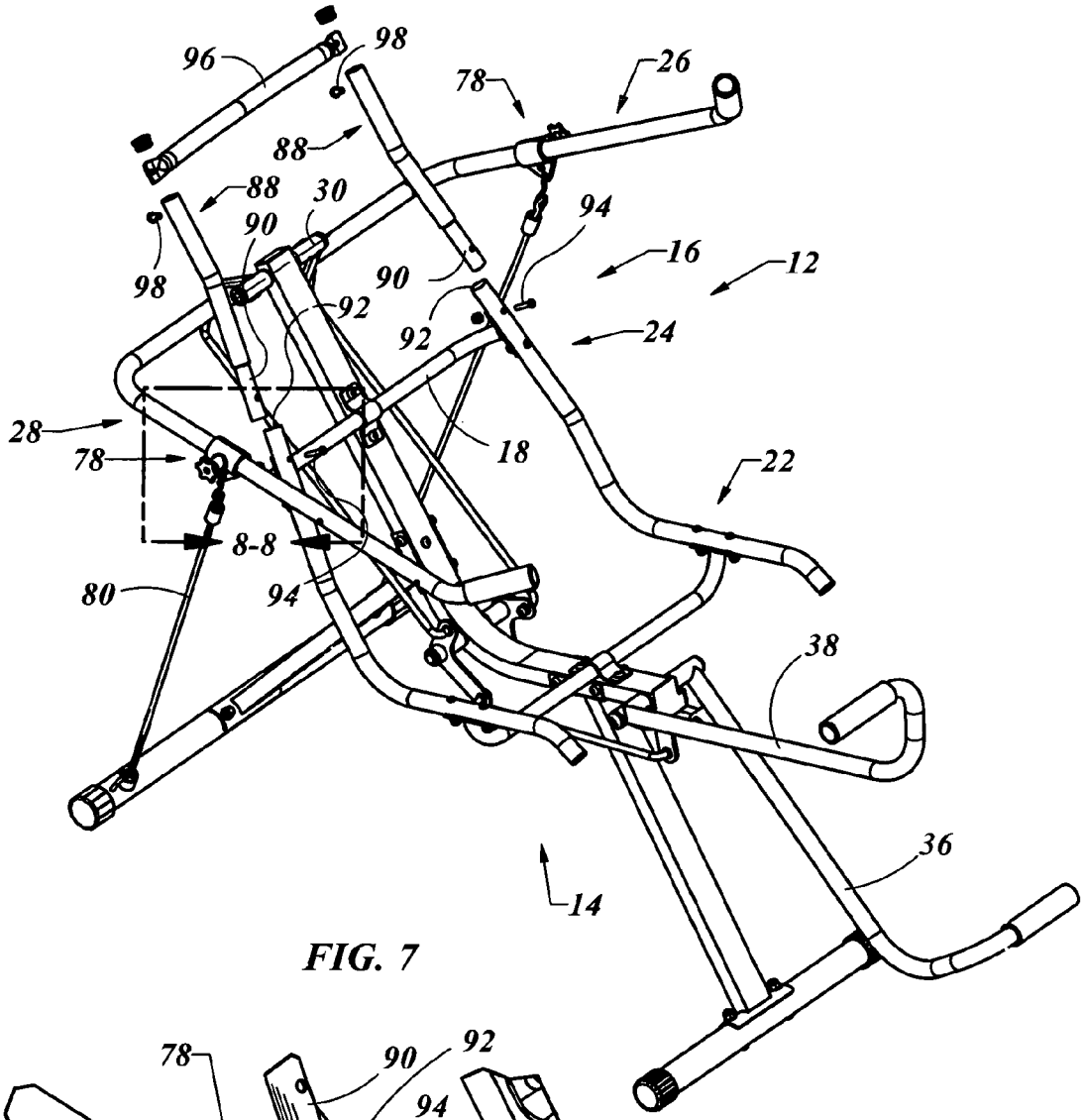
FIG. 7 is a right front isometric view of the exercise device of FIG. 1 with the seat cover removed and showing a knock down feature of the seat frame.
Figure 8:
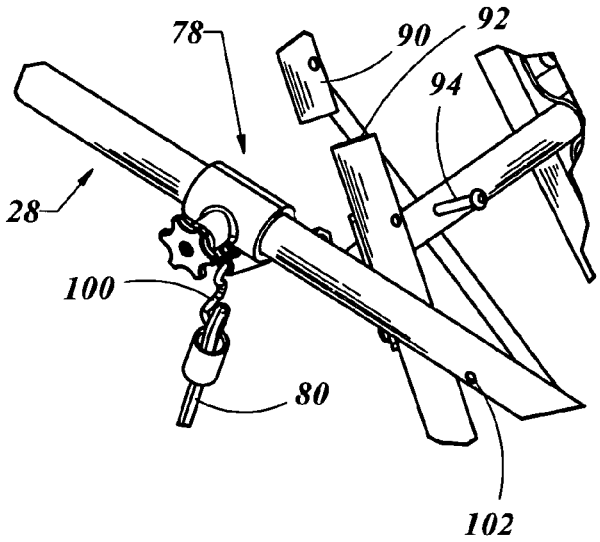
FIG. 8 is an isometric detailed view of the slide block cut along line 8-8 of FIG. 7.

With reference to FIGS. 7 and 8, a right front isometric view of the apparatus 12 is shown with the cover 68 (FIG. 2) removed to better show the structure and FIG. 8 shows a detail of the second arm 28 and the slide block 78. The seat frame 16 may be comprised of a bottom portion 22 and a back portion 24. The seat frame 16 is shown here to be constructed of round tubular material. This has been determined by the applicant to be the preferred embodiment, but other construction types and materials may be used. In one form of the apparatus 12 it may be desirable to allow the apparatus 12 to knock down to a smaller shipping or storage package. Though many components do disassemble and therefore facilitate that process, the seat frame 16 may still be a larger component. To further enhance this knock down feature, a portion of the seat frame 16 may be constructed of parts that may be assembled easily, mounted securely and in a manner that minimizes the appearance of the juncture. One example is depicted in FIG. 7 where the seat back portion 24 includes a pair of top ends 88 that include a reduced area 90. The reduced area 90 may be received by open ends 92 of the back portion 24. Fasteners 94 may be used to secure the back portion 24, top ends 88 and the first cross brace 18 together to make a structurally sound assembly. Receiving the reduced area 90 into the open ends 92 of the back portion 24 and securing it to an existing brace that is part of the first cross brace 18 may make the juncture of the parts virtually undetectable, thus providing aesthetic beauty for the assembled seat frame 16. A third seat cross brace 96 may support the seat frame 16 at an upper portion of the top ends 88 by second fasteners 98 to further secure the seat frame 16 and provide a support for the flat back portion 70 (FIG. 2).

Also shown in FIG. 8 is a detail of the slide block 78 assembled onto the second arm 28. The bias member 80 may be attached to the slide block 78 by way of an S-hook 100. The slide block 78 may be allowed to move along a portion of the length of the arm 28 to vary the moment arm of the bias member 80 with respect to the arm axis 30. The slide block may be secured to one or more fixed positions on the arm 28 by way of a engagement with one or more arm holes 102

Figures 9, 10:
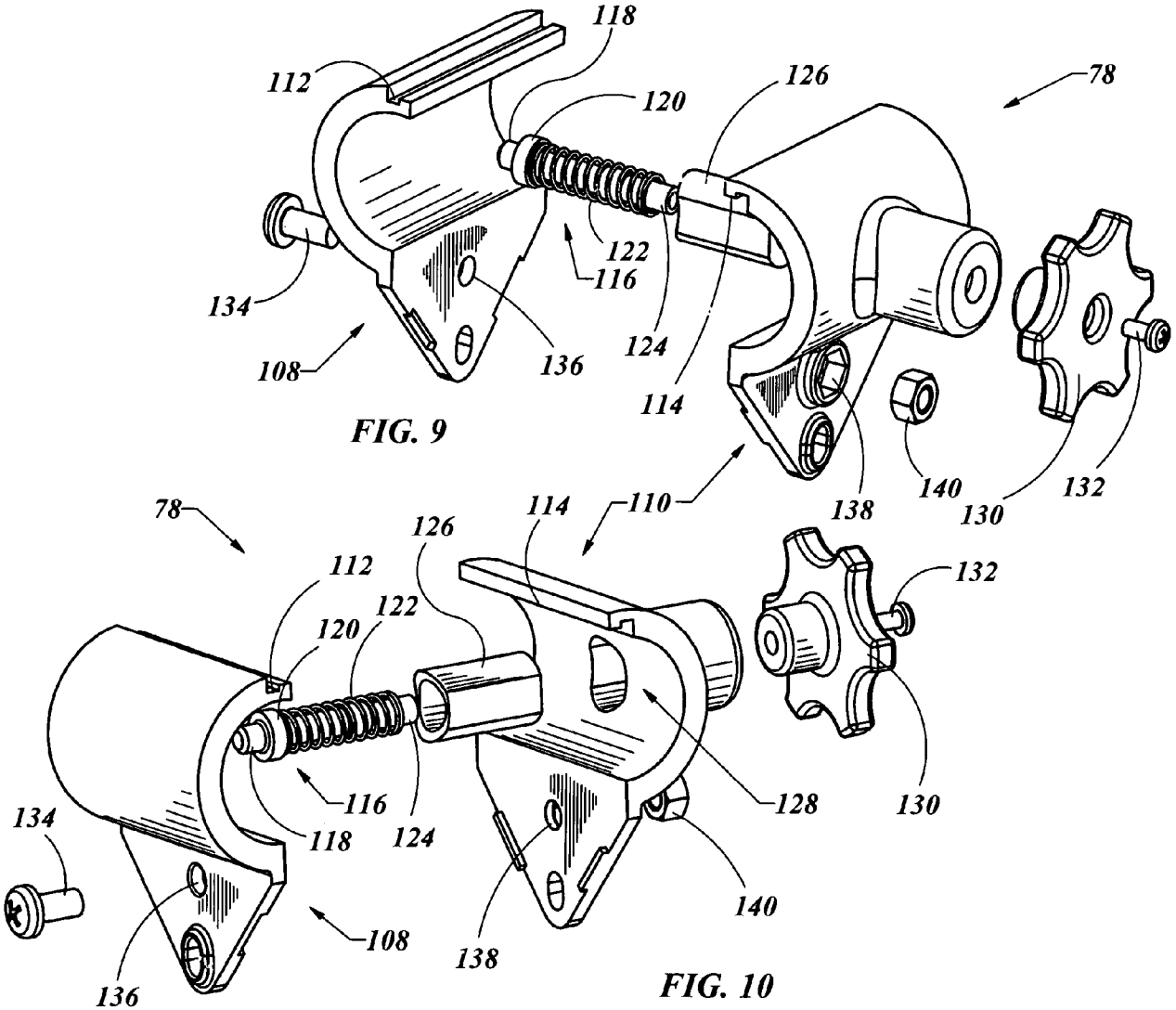
FIG. 9 is an isometric partially disassembled view of a slide block mechanism shown from an outside perspective.
FIG. 10 is an isometric partially disassembled view of the slide block mechanism of FIG. 9 shown from an inside perspective.
Figure 11:
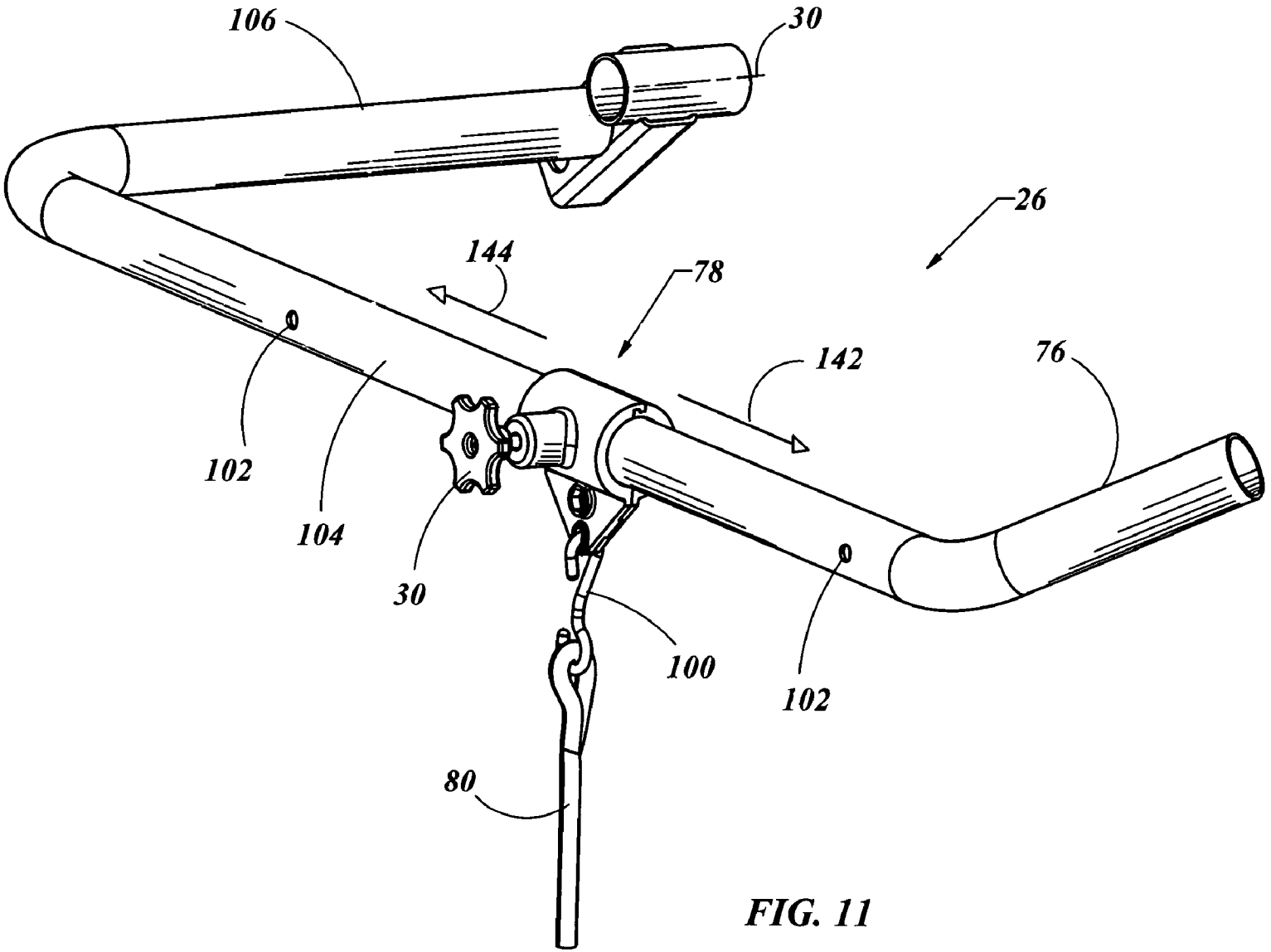
FIG. 11 is an isometric view of the right arm and slide block assembly with a section of the bias member of FIG. 1.

Referring to FIGS. 9-11, a detail of one embodiment of a slide block 78 with components partially displaced is shown from a first perspective in FIG. 9 and an opposing perspective in FIG. 10 and assembled mounted on a first arm link 26 in FIG. 11. The second arm link 28 may be a mirror image of the first arm link 26 so in this embodiment all elements and features of the first arm 26 may be applied to the second arm 28. In this embodiment of the apparatus 12, the first arm link 26 and the second arm link 28 both include a slide block 78 and they are received on a long portion 104 of the arms 26 and 28. In this embodiment the hand grip 76 may be formed into the arm links 26 and 28 to provide better ergonomic interaction with the user. An arm back 106 may be provided adjacent to the arm axis 30 to allow the user to be positioned between the long portion 104 of the first arm link 26 and the second arm link 28 when seated on the apparatus 12. In this embodiment a secure contact of the slide block 78 with the long portion 104 positioned between the hand grip 76 and the arm back 106 may be enabled by use of a two-part block body.

In FIGS. 9 and 10 the two part block body may include an inside block 108 that is shown separated from an outside block 110. This view of separated elements is done for illustrative purposes. An alignment groove 112 may be provided in the inside block 108 to be received by an alignment lip 114 in the outside block 110. The alignment groove 112 may be adapted to receive the alignment lip 114 to align and add structural support to the assembly of the inside block 108 to the outside block 110. This is one embodiment and the lip 114 may be present on the inside block 108 and the groove 112 on the outside block 110 just as well as the reverse as is shown here. An engagement pin 116 may include a receiver tip 118 adjacent to a pin flange 120. A compression spring 122 may rest on a shank 124 of the engagement pin 116, the compression spring 122 supported on one end by the pin flange 120. The engagement pin 116 and the compression spring 122 may be received by a sleeve 126 to guide and house the engagement pin 116 and compression spring 122 as they are all received by a block cavity 128 in the outside block 110. A knob 130 may be fixed to the engagement pin 116 by a knob screw 132 to hold the then partially compressed compression spring 122 and the engagement pin 116 in the block cavity 128.

This assembly also allows displacement of the knob 130 away from the inside block 108 to further compress the compression spring 122, thus biasing the receiver tip 118 toward the inside block 108. The outside block 110 with the engagement pin 116, compression spring 122, sleeve 126 and knob 130 may be assembled and positioned on the long portion 104 of either arm link 26 and 28 with the receiver tip 118 received by one of the holes 102. The inside block 108 may then be received onto the long portion 104 and engaged with the outside block 110 by sliding the inside block 108 toward the outside block 110 with the lip 114 received by the groove 112. When the inside block 108 is aligned with the outside block 110 a screw 134 may be inserted through the inside block hole 136 and the outside block hole 138 and secured with a nut 140 to secure the assembly together on the long portion 104 of the arm link 26 and 28.

Again referring to FIG. 11, the S-hook 100 may be used to connect the bias member 80 to the slide block 78. The knob 130 may be pulled, compressing the compression spring 122 thereby disengaging the receiver tip 118 (FIGS. 9-10) from a hole 102. This allows the slide block 78 to move toward the hand grip 76 as depicted by the first arrow 142 to increase the affect of the bias member 80 on the arm link 26 and 28 or away from the hand grip 76 as depicted by the second arrow 144 to decrease the affect of the bias member 80. By releasing the knob 130, the compression spring 122 will bias the engagement pin 116 to position the receiver tip 118 into a hole 102 to the depth of the pin flange 120. This secures the slide block 78 in a set position until it is moved by the user. This is only one embodiment of the locking system to secure the slide block 78 relative to a position on the arm 26 and 28. A friction lock device may also be used providing greater variation in adjustment and eliminate the need for the holes 102 but this may make the slide block 78 more susceptible to inadvertent movement during use. As such the applicant provides the embodiment as shown and described.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. An exercise device, comprising:

a frame;

a pair of arm links pivotally coupled directly to the frame about a first axis;

a pair of leg links pivotally coupled to the frame about a second axis, the first axis non-collinear with the second axis;

a first countermovement mechanism pivotally coupled to the frame about a third axis and adapted to provide a user defined range of motion of a first arm link of the pair of arm links that is substantially opposite in direction to a first leg link of the pair of leg links; and a second countermovement mechanism pivotally coupled to the frame about the third axis and adapted to provide a user defined range of motion of a second arm link of the pair of arm links that is substantially opposite in direction to a second leg link of a pair of leg links, the second countermovement mechanism being independent from the first countermovement mechanism, whereby a user positioned on the device grasping the pair of arm links can move the arm links in the same direction flexing the body of the user to perform an abdominal exercise or in opposing directions with the feet of the user on the pair of leg links to perform a simulated walking gait exercise.

2. The exercise device as described in claim 1, further comprising a bias member with a first end coupled to the frame and a second end coupled to the first arm link.

3. The exercise device as described in claim 2, wherein the second end of the bias member is movably coupled to the first arm link.

4. The exercise device as described in claim 2, wherein the bias member is coupled a slide block movably mounted to the first arm link.

5. The exercise device as described in claim 4, wherein the slide block includes an indexing pin adapted to secure the slide block in a position on the first arm link.

6. The exercise device as described in claim 2, wherein the bias member is a member selected from the group consisting of a spring, an elastic cord and a pneumatic cylinder.

7. The exercise device as described in claim 1, further comprising a seat coupled to the frame, the seat including a substantially flat back portion contiguous to a substantially flat lower portion.

8. The exercise device as described in claim 7, wherein the seat is comprised of a seat frame including a base section and a removable section that is releasably secured to the base section adjacent to a seat cross brace.

9. The exercise device as described in claim 7, wherein the back portion is positioned at an angle of approximately 111 degrees relative to the lower portion of the seat.

10. The exercise device as described in claim 1, wherein a ratio of movement of the first leg link to the first arm link is approximately 4/3.

11. An exercise device, comprising:

a frame supporting a seat;

a pair of arm links pivotally coupled to the frame about a first axis;

a pair of leg links pivotally coupled to the frame about a second axis, the first axis non-collinear with the second axis; and a countermovement means coupled to the pair of arm links, the pair of leg links, and directly to the frame, whereby a user positioned on the seat and grasping the pair of arm links can move the arm links in the same direction flexing the body of the user to perform an abdominal exercise or in opposing directions with the feet of the user on the pair of leg links to perform a simulated walking gait exercise.

12. The exercise device as described in claim 11, further comprising a bias member with a first end coupled to the frame and a second end coupled to an arm link of the pair of arm links.

13. The exercise device as described in claim 12, wherein the second end of the bias member is movably coupled to an arm link of the pair of arm links.

14. The exercise device as described in claim 12, wherein the bias member is coupled a slide block movably mounted to an arm link of the pair of arm links.

15. The exercise device as described in claim 14, wherein the slide block includes an indexing pin adapted to secure the slide block in a position on the arm link.

16. The exercise device as described in claim 12, wherein the bias member is a member selected from the group consisting of a spring, an elastic cord and a pneumatic cylinder.

17. An exercise device, comprising;

a frame;

a seat including a bottom portion contiguous to a back portion, the seat coupled to the frame;

a pair of arm links pivotally coupled directly to the frame proximal to the back portion of the seat and distal to the bottom portion of the seat;

a pair of leg links pivotally coupled to the frame, proximal to the lower portion of the seat and distal to the back portion of the seat; and a countermovement mechanism pivotally coupled to the frame and adapted to provide a user defined range of motion of each arm link of the pair of arm links that is substantially opposite in direction to a leg link of the pair of leg links, whereby a user positioned on the seat and grasping the pair of arm links can move the arm links in the same direction flexing the body of the user to perform an abdominal exercise or in opposing directions with the feet of the user on the pair of leg links to perform a simulated walking gait exercise.

18. The exercise device as described in claim 17, further comprising a bias member with a first end coupled to the frame and a second end coupled to the arm link.

19. The exercise device as described in claim 18, wherein the second end of the bias member is movably coupled to the arm link.

20. The exercise device as described in claim 18, wherein the bias member is coupled to a slide block movably mounted to the arm link.

21. The exercise device as described in claim 20, wherein the slide block includes an indexing pin adapted to secure the slide block in a position on the arm link.

22. The exercise device as described in claim 18, wherein the bias member is a member selected from the group consisting of a spring, an elastic cord and a pneumatic spring.

23. The exercise device as described in claim 17, wherein a ratio of movement of the leg link relative to the arm link is approximately 4/3.

24. The exercise device as described in claim 17, wherein the seat is further comprised of a seat frame including a base section and a removable section that is releasably secured to the base section adjacent to a seat cross brace.

25. A method of exercise for use with an exercise device including a frame, a seat coupled to the frame, a pair of arm links pivotally coupled to the frame about a first axis, a pair of leg links pivotally coupled to the frame about a second axis, the first axis non-collinear with the second axis and a countermovement mechanism pivotally coupled directly to the frame and adapted to provide a user defined range of motion of an arm link of the pair of arm links that is substantially opposite in direction to a leg link of the pair of leg links, the method of exercise including the steps of:

positioning a user in the seat and grasping the arm links and positioning their feet on the leg links;

moving the arms and legs of the user in an opposing manner so as to simulate a walking gait; and moving the arms of the user in the same direction and the legs of the user in the same direction, and the legs opposite to the arms, so as to perform an abdominal exercise.

26. The method according to claim 25, further including the steps of:

providing a bias member coupled to the frame and a slide block received by the arm link;

positioning the slide block relative to the first axis; and securing the slide block to the arm link.

* * * * *